US006151710A

United States Patent [19]

Bachner, Jr.

[11] Patent Number: 6,151,710

[45] Date of Patent: Nov. 28, 2000

[54] MULTI-COMPONENT LIGHTWEIGHT BALLISTIC RESISTANT GARMENT

[75] Inventor: Thomas E. Bachner, Jr., Eastport, Mich.

[73] Assignee: Second Chance Body Armor, Inc., Central Lake, Mich.

[21] Appl. No.: 09/174,108

[22] Filed: Oct. 17, 1998

[51] Int. Cl.[7] ..... F41H 1/02

[52] U.S. Cl. ..... 2/2.5

[58] Field of Search ..... 2/2.5; 428/911; 89/36.05, 36.01, 36.02

[56] References Cited

U.S. PATENT DOCUMENTS

| | | | |
|---|---|---|---|
| 3,974,313 | 8/1976 | James . | |
| 4,608,717 | 9/1986 | Dunbavand | 2/2.5 |
| 4,989,266 | 2/1991 | Borgese et al. | 2/2.5 |
| 5,120,599 | 6/1992 | Lewis . | |
| 5,179,244 | 1/1993 | Zufle . | |
| 5,180,880 | 1/1993 | Zufle . | |
| 5,185,195 | 2/1993 | Harpell et al. . | |
| 5,196,252 | 3/1993 | Harpell et al. . | |
| 5,198,280 | 3/1993 | Harpell et al. . | |
| 5,233,821 | 8/1993 | Weber, Jr. et al. . | |
| 5,343,796 | 9/1994 | Cordova et al. . | |
| 5,440,965 | 8/1995 | Cordova et al. . | |
| 5,443,882 | 8/1995 | Park . | |
| 5,443,883 | 8/1995 | Park . | |
| 5,461,839 | 10/1995 | Beck . | |
| 5,466,503 | 11/1995 | Dischler . | |
| 5,479,659 | 1/1996 | Bachner, Jr. | 2/2.5 |
| 5,526,627 | 6/1996 | Beck . | |
| 5,545,455 | 8/1996 | Pevorsek et al. . | |
| 5,569,509 | 10/1996 | Dischler . | |
| 5,589,254 | 12/1996 | Dischler . | |
| 5,595,809 | 1/1997 | Dischler | 428/113 |
| 5,619,748 | 4/1997 | Nelson et al. | 2/2.5 |
| 5,635,288 | 6/1997 | Park . | |
| 5,677,029 | 10/1997 | Prevorsek et al. | 428/113 |
| 5,724,670 | 3/1998 | Price | 2/2.5 |
| 5,773,370 | 6/1998 | Dunbar et al. . | |
| 5,776,838 | 7/1998 | Dellinger . | |
| 5,788,907 | 8/1998 | Brown, Jr. et al. . | |
| 5,839,247 | 11/1998 | Beck . | |
| 5,918,309 | 7/1999 | Bachner, Jr. | 2/2.5 |
| 5,926,842 | 7/1999 | Price et al. | 2/2.5 |
| 5,935,678 | 8/1999 | Park | 428/105 |
| 5,958,804 | 9/1999 | Brown, Jr. et al. . | |
| 5,965,223 | 10/1999 | Andrews et al. . | |

OTHER PUBLICATIONS

Toyobo Co., Ltd. PBO Fiber Zylon$_{TM}$ New High Performance Fiber Pioneered by Toyobo, Undated, 6 Pages, by Toyobo Co., Ltd., Osaka, Japan.

*Primary Examiner*—Michael A. Neas

*Attorney, Agent, or Firm*—Thomas J. Ring; Wildman, Harrold, Allen & Dixon

[57] ABSTRACT

A ballistic resistant protective garment having a ballistic resistant pad which has at least three panels including a first panel constructed of a plurality of overlying layered sheets in which each sheet is constructed of a first type of high tensile strength woven fiber, a second panel constructed of a plurality of overlying layered sheets in which each sheet is constructed of lyotropic liquid crystal polymer material, and a third panel constructed of plurality of overlying layers of composite body armor material positioned at a body side of the pad in which the first, second and third panels are in overlying relationship to one another to form the pad. The employment of the panel of layered sheets of lyotropic liquid polymer fibers introduces a synergistic effect with the ballistic resistant materials of the other panels. The synergistic effect enhances the anti-ballistic performance of the high strength material of the other panels through increased lateral energy dispersion, reduces bunching and balling of the pad in a National Institute of Justice (NIJ) laboratory test environment and further improves blunt trauma performance.

89 Claims, 6 Drawing Sheets

55
58
56A
57A
56B
57B
56C
57C
56D
57D
59

MULTI-COMPONENT LIGHTWEIGHT BALLISTIC RESISTANT GARMENT

FIELD OF THE INVENTION

The present invention relates to protective garments for resisting ballistic forces and more particularly to multi-component ballistic resistant pads formed of layered materials in such protective garments.

BACKGROUND OF THE INVENTION

In the evolution of protective garments, there has been an ever pressing desire to develop stronger, lighter, thinner, cooler, more breathable and thereby more wearable garments. Such garments are intended to resist certain potentially lethal forces such as those from gun shots. Typically, these garments are designed to protect the wearer from ballistic forces by preventing penetration through the garment from a projectile bullet.

Attempts at developing thin, light, less insulating, flexible and breathable protective body armor have been made in order to create garments that are more wearable to the user. The more light and thin and the less insulating the protective ballistic resistant garment is, the more likely the user (such as a law enforcement officer) will actually wear the garment, especially during the long hours of a working shift.

It is also desirable to have the protective body armor garment cover as much of the wearer's torso as possible while also maintaining wearability. The thinner and lighter the protective article, the more coverage can be offered. Concealability of the anti-ballistic body armor may also be improved if it is constructed to be thin and non-bulky. These attempts at developing thin and lightweight ballistic resistant body armor articles have also been made to try to allow increased freedom of movement and mobility so that the law enforcement officer wearing the article is not hampered from doing his or her job.

These attempts at reducing weight while improving the thinness of the article have previously been made by the utilization of layers of sheets of aramid fibers. High tensile strength aramid fibers such as Kevlar® produced by E. I. DuPont de Nemours & Company of Wilmington, Del., have often been employed in forming the woven ballistic fabric. Aramids such as Twaron® T-1000 and Twaron® T-2000 of AKZO NOBEL, Inc. have also been used in forming woven sheets of material in ballistic resistant pads. However, to increase the level of protection against higher caliber pistols and firearms more layers of ballistic resistant fabric are unfortunately required thereby increasing the overall weight and thickness of the garment while reducing its flexibility. Thus, there has been a long felt need to construct ballistic resistant pads which have improved wearability through the employment of lightweight and flexible high strength materials.

Various voluntary governmental ballistic standards have been established to certify certain ballistic resistant garments. The tests determine the ability of the garment to resist penetration from various ballistic rounds shot from various types of weapons. In particular, the National Institute of Justice (NIJ) Standard 0101.03 certification tests are frequently used in testing certain body armor products. The NIJ Standard 0101.03 tests are grouped into different threat levels, with each threat level corresponding to ballistic projectile penetration stopping capabilities of various ballistic rounds fired from designated weapons. For generally concealable type ballistic resistant body armor, NIJ Standard certification tests are often performed for NIJ Threat Levels IIA, II and IIIA. NIJ Threat Level IIIA is a higher standard level than NIJ Threat Level II and which in turn is a higher standard level than NIJ Threat Level IIA. There is therefore a need to provide thin and lightweight protective body armor garments having low insulating properties to increase their wearability, while also meeting test specifications of NIJ Standard 0101.03 Threat Level IIA, II and IIIA certification tests.

SUMMARY OF THE INVENTION

The foregoing needs noted above are met in accordance with the present invention by a ballistic resistant protective garment having a ballistic resistant pad which has at least two panels with a first panel constructed of a plurality of overlying layered sheets constructed of woven lyotropic liquid crystal polymer fiber positioned at a strike side of the pad and having a second panel constructed of a plurality of overlying layers of sheets of composite body armor material positioned at a body side of the pad in which the first panel overlies the second panel and in which the first and second panel are held together in alignment to one another.

It is a further object of this invention to provide a ballistic resistant protective garment having a ballistic resistant pad having a first panel constructed of a plurality of overlying layered sheets constructed of woven lyotropic liquid crystal polymer fibers and having a second panel constructed of a plurality of overlying layers of composite body armor material in which the first panel overlies the second panel to form a pad and the first panel is positioned at a strike side of the pad and the second panel is positioned at a body side of the pad and in which the pad has an areal density not greater than 0.65 lbs/ft$^2$, 0.74 lbs/ft$^2$ and 0.93 lbs/ft$^2$ for a ballistic resistance that prevents projectile penetration of the ballistic resistant pad according to NIJ Standard 0101.03 for Threat Levels IIA, II and IIIA respectively.

It is a further object of this invention to provide a ballistic resistant protective garment having a ballistic resistant pad having a first panel constructed of a plurality of overlying layered sheets constructed of woven lyotropic liquid crystal polymer fibers and having a second panel constructed of a plurality of overlying layers of composite body armor material in which the first panel overlies the second panel to form a pad and the first panel is positioned at a strike side of the pad and the second panel is positioned at a body side of the pad and in which the pad has a thickness not greater than 0.16 inches, 0.18 inches and 0.23 inches for a ballistic resistance that prevents projectile penetration of the ballistic resistant pad according to NIJ Standard 0101.03 for Threat Levels IIA, II and IIIA respectively.

It is a further object of this invention to provide a ballistic resistant protective garment which has a ballistic resistant pad having at least three panels with a first panel constructed of a plurality of overlying layered sheets in which each sheet is constructed of a first type of high tensile strength woven fibers and a second panel constructed of a plurality of overlying layered sheets in which each sheet is constructed of lyotropic liquid crystal polymer fibers and a third panel constructed of a plurality of overlying layers of composite body armor material positioned at a body side of the pad in which the first, second and third panels are in overlying relationship to one another.

It is a further object of this invention to provide a ballistic resistant protective garment having a ballistic resistant pad which has at least three panels which includes a first panel constructed of a plurality of overlying layered sheets in which each sheet is constructed of a first type of high tensile strength woven fibers, a second panel constructed of a plurality of overlying layered sheets in which each sheet is constructed of lyotropic liquid crystal polymer fibers, and a third panel constructed of a plurality of overlying layers of composite body armor material positioned at a body side of the pad in which the first, second and third panels are in overlying relationship to one another to form a pad in which the pad has an areal density not greater than 0.63 lbs/ft$^2$, 0.74 lbs/ft$^2$ and 0.94 lbs/ft$^2$ for a ballistic resistance that prevents projectile penetration of the ballistic resistant pad according to NIJ Standard 0101.03 for Threat Levels IIA, II and IIIA respectively.

It is a further object of this invention to provide a ballistic resistant protective garment having a ballistic resistant pad which has at least three panels which includes a first panel constructed of a plurality of overlying layered sheets in which each sheet is constructed of a first type of high tensile strength woven fibers, a second panel constructed of a plurality of overlying layered sheets in which each sheet is constructed of lyotropic liquid crystal polymer fibers, and a third panel constructed of a plurality of overlying layers of composite body armor material positioned at a body side of the pad in which the first, second and third panels are in overlying relationship to one another to form a pad in which the pad has a thickness not greater than 0.16 inches, 0.19 inches and 0.24 inches for a ballistic resistance that prevents projectile penetration of the ballistic resistant pad according to NIJ Standard 0101.03 for Threat Levels IIA, II and IIIA respectively.

BRIEF DESCRIPTION OF THE DRAWING

The foregoing objects and advantageous features of the invention will be explained in greater detail and others will be made apparent from the detailed description of the various embodiments of the present invention which are given with reference to the several figures of the drawing, in which.

DETAILED DESCRIPTION

Figure 1:
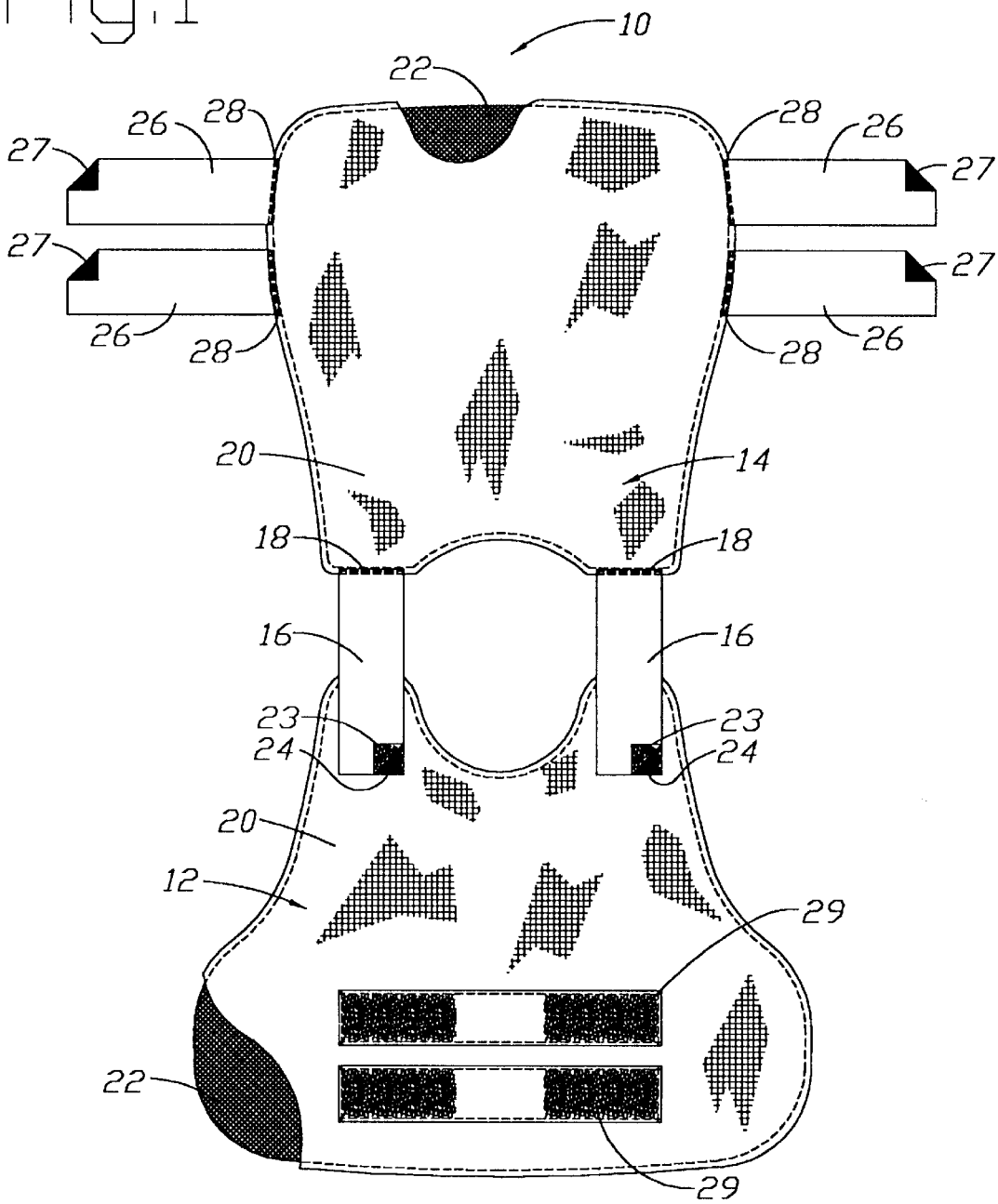
FIG. 1 is an a plan view of a ballistic resistant garment of the present invention partially broken away to illustrate a pad cover underlying an outer carrier.

Referring now to FIG. 1, ballistic resistant protective garment 10 for covering and protecting vital portions of a person's body supporting the garment is shown. The multi-component lightweight ballistic resistant garment 10 of FIG. 1 has a front garment section 12 for generally covering the front region of a wearer and a back garment section 14 for generally covering a back region of the wearer. Adjustably connecting the front section 12 and back section 14 are shoulder straps 16. The ends 18 of shoulder straps 16 are preferably secured (by stitching or other suitable means) to an outer cloth carrier 20 of the back section 14 of the garment. Carrier 20 carries a ballistic resistant pad (in both the front and back garment sections) which is discussed in more detail below. The ballistic resistant pad is removable from carrier 20 for replacement when desired. The outer carrier 20 encloses and carries the pad and pad cover 22 and supports the covered pad against the body of the wearer.

Additionally, each ballistic resistant pad 30, 60 (FIGS. 3, 6) is covered and enclosed within pad cover 22, FIG. 1, which may selectively be constructed of water resistant and vapor permeable material such as GORE-TEX®, as shown in the break away views of FIG. 1. Alternatively, the pad cover 22 is selectively made of ripstop nylon material having a urethane coating. Pad cover 22 may selectively be made of White Supplex® treated with dynamic water repellent, a highly breathable material formed from nylon fiber by E. I. DuPont de Nemours & Company of Wilmington, Del. As seen in FIG. 1, opposing ends 23 of the shoulder straps 16 are shown having releasably securable hook and loop fasteners or VELCRO® which engage corresponding mating fastener pad members 24 placed at a shoulder region of the outer carrier 20 of the front garment section 12. The shoulder straps 16 are adjustable to move the front 12 and back 14 sections to a desired position over the torso region of the body of the wearer.

In use, the front section 12 and back section 14 of the garment may also be suitably secured at their side regions by side straps 26. The side straps 26 are secured at one end 28 by stitching or other suitable means to the outer carrier 20 of the back section 14. The opposing ends 27 of the side straps 26 preferably have VELCRO® type hook and loop fasteners which are placed upon the outer cloth carrier at the front section 12 of the garment. The side straps 26 are pulled about the torso of the wearer and the free ends 27 are overlaid and engage mating pads 29 to comfortably fit the garment 10 about the body of the wearer.

Figure 2:
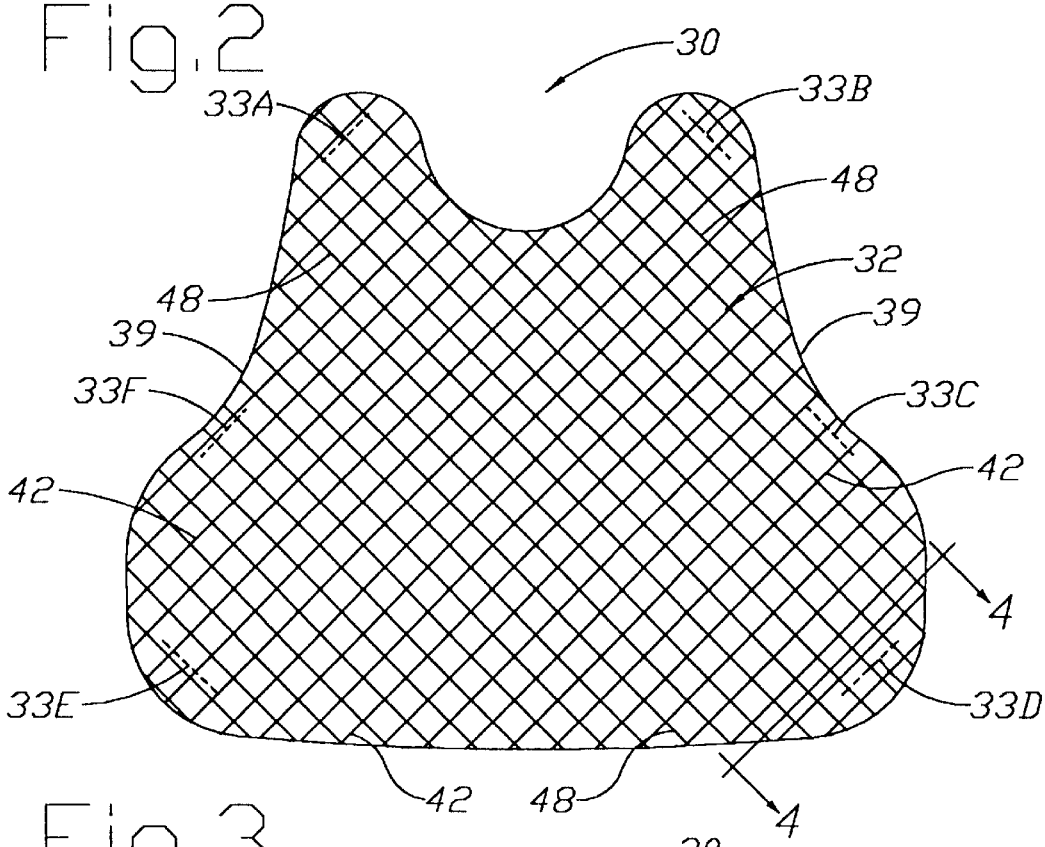
FIG. 2 is a plan view of one embodiment of the ballistic resistant pad of the present invention.
Figure 3:
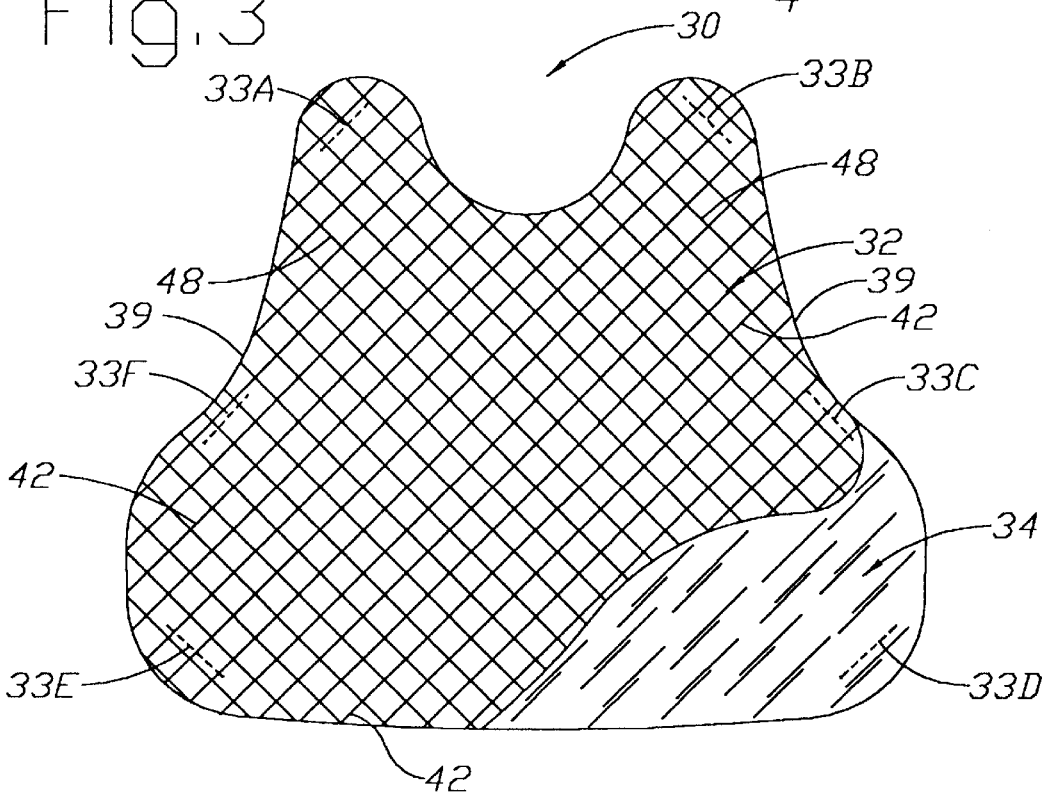
FIG. 3 is an is a plan view of the embodiment shown in FIG. 2 partially broken away to illustrate the underlying panel.

Referring now to FIG. 2, a ballistic resistant pad 30 of bi-component construction is shown. The bi-component pad 30 as seen in FIG. 3 has at least two panels 32, 34 in which the first panel 32 is positioned at a strike side of the pad and is constructed of a plurality of overlying sheets of woven lyotropic liquid crystal polymer fibers. The second underlying panel 34, FIG. 3, is positioned at a body side of the pad and is constructed of overlying layers of composite body armor material. The strike side panel 32 and body side panel 34, FIG. 3, are held together in alignment to one another by a plurality of bar tac stitches 33A–33F. The bi-component pad 30 includes at least one row of bar tac stitches 33 positioned in the peripheral area of the protective pad 30 which is stitched entirely through and secures the first strike side panel 32 and second body side panel 34 together. At least four rows of bar tac stitching may suitably be employed, however, six rows of bar tac stitches 33A–33F equally positioned about the periphery of the pad 30 is preferred. Each of the rows of bar tacs 33A–33F are positioned at the perimeter of the pad 30 and are no longer than one inch in length to reduce potential tearing of the composite material in panel 34 proximate the bar tacs. Alternatively, the panels 32, 34 are held together by simply being snugly confined within the pad cover 33 which provides alignment of the strike side and body side panels.

Figure 4:
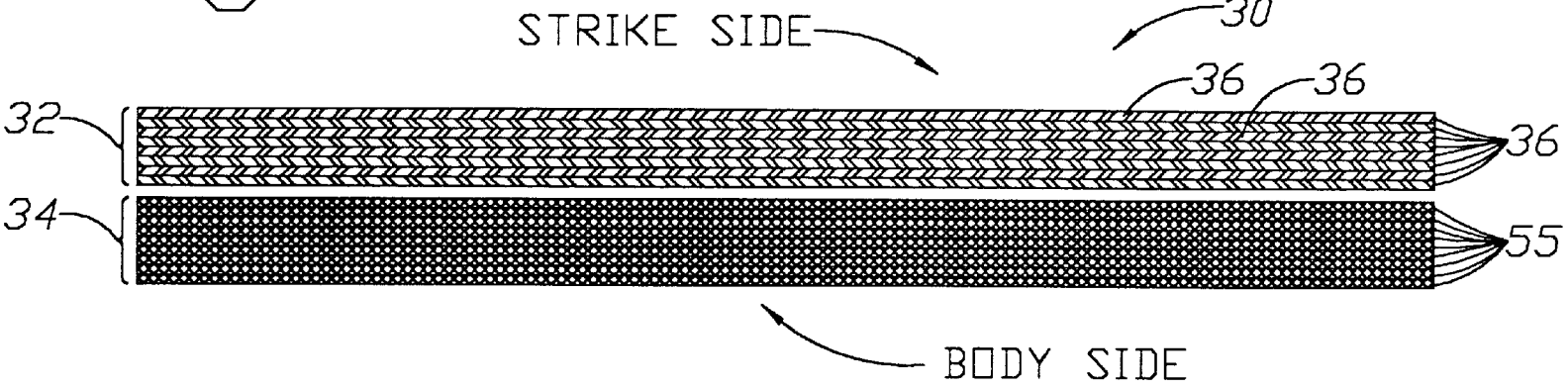
FIG. 4 is a cross sectional view taken along line 4—4 of FIG. 2.
Figure 8:
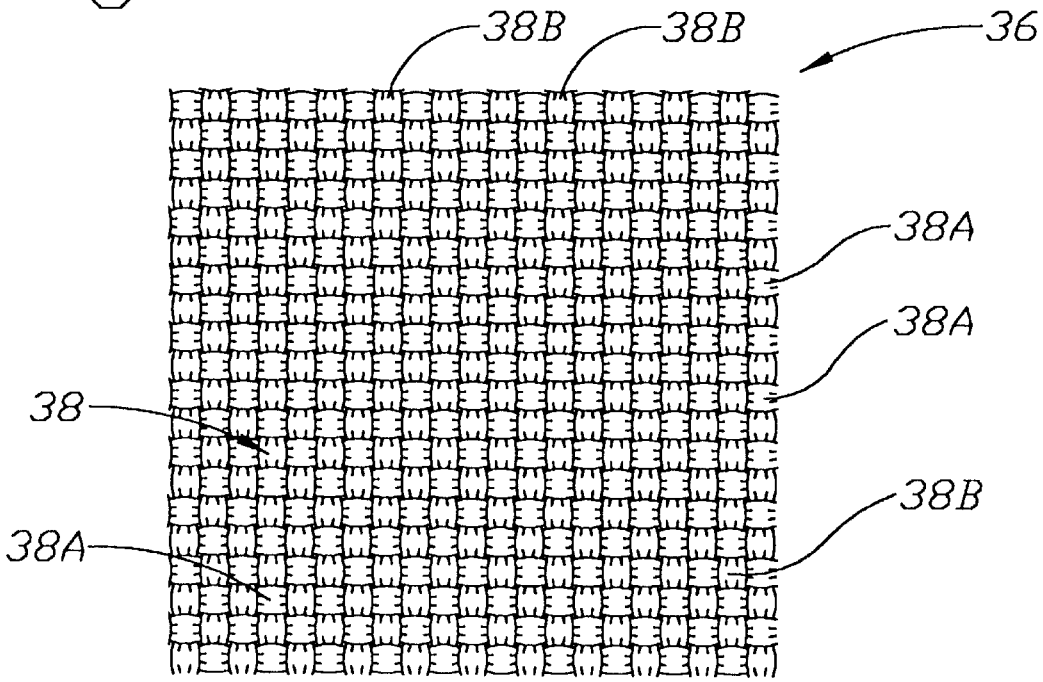
FIG. 8 is an enlarged partial view representative of balanced weave of a sheet of woven lyotropic liquid crystal polymer fibers of the present invention.

The strike side panel 32, FIG. 2, is constructed of overlying layered sheets 36, FIG. 4, of woven lyotropic liquid crystal polymer fiber. Referring ahead now to FIG. 8, an enlarged partial view representative of the weave of a sheet 36 of woven lyotropic liquid polymer fibers 38 is shown. The individual plies or sheets 36 of the strike side panel 32, FIG. 2, are preferably formed by a balanced weave of fibers 38. The weave for the sheets 36 constructed of the lyotropic liquid crystal polymer fibers 38 has a warp to fill ratio of 30 by 30 fibers per inch. There are thirty horizontal warp fibers 38A, FIG. 8, and thirty vertical fill fibers 38B per inch for a sheet 36 of woven lyotropic liquid crystal polymer fiber 38.

Each of the woven overlying sheets 36, FIGS. 4 and 8, are preferably constructed of a rigid-rod lyotropic liquid crystal polymer fiber formed from poly(p-phenylene-2,6-benzobisoxazole) (PBO) developed by Toyobo Co. Ltd. of Osaka, Japan and sold under the trademark ZYLON®. The high strength and heat resistant poly(p-phenylene-2,6-benzobisoxazole) (PBO) fiber woven in to the sheets 36 and incorporated into the strike side ballistic resistant panel 32 further enables the pad 30 to provide high penetration resistance while being thin, lightweight, flexible and cool thereby enhancing the wearability of the garment. The lyotropic liquid crystal polymer fiber material 38, FIG. 8, has a filament denier of 1.5 dpf (denier per foot) and a density ranging from 1.54 to 1.56 g/cm$^3$. The PBO fiber 38 preferably employed has a tensile strength at 42 grams/denier and 840 KSI (thousand pounds per square inch). Additionally, the preferred PBO fiber 38, FIG. 8, has a tensile modulus ranging from 1300 to 2000 grams/denier and a decomposition temperature in air of 650 degrees centigrade. The elongation at break for the lyotropic liquid crystal polymer fiber 38, FIG. 8, ranges from 2.5 percent to 3.5 percent.

Referring again to FIG. 2, the first panel 32 is shown having a plurality of rows of stitches 42, 48 which secure the overlying layered sheets 36 of woven PBO material to form the individual panel. A first plurality of rows of stitches 42 and another plurality of rows of stitches 44 form a pattern of quilt stitches in the first or strike side panel 32. The plurality of stitches 42 are disposed only in the first panel 32 connecting the overlying sheets 36, FIG. 4, of woven PBO material together within the first panel. As seen in FIG. 2, the strike side panel 32 includes rows of stitches 42 which are aligned in a first direction and at least one other row 48 (preferably a plurality of rows) of stitches aligned in a second direction in which the rows of stitches 42, 48 in the first and second directions are transverse to one another. Preferably, rows of stitches 42 and other crossing rows of stitches 48 are substantially perpendicular to one another to form the pattern of quilt stitches.

The rows of stitches 42 angled in the first direction are substantially parallel to one another and are spaced apart approximately 1.25 inches from one another. Similarly, the other rows of stitches 48 are also substantially parallel to one another and are spaced approximately 1.25 inches apart from one another. Rows 42 and the other rows 48 of stitches of the first strike side panel 32 each extend substantially across the first panel. Preferably, the stitches 42, 48 are composed of an aramid fiber such as Kevlar® sewing thread developed by E. I. DuPont de Nemours & Co. of Wilmington, Del. and are sewn at approximately four stitches per inch. Alternatively, other high strength penetration resistant materials such as Spectra® fibers produced by Allied Signal, Inc. of Morris County, N.J. or PBO fibers developed by Toyobo Co. maybe suitably employed as stitches in the panels.

Referring to FIG. 3, the second underlying panel or body side panel 34 is constructed of a plurality of overlying layers 55, FIG. 4, of composite body armor material. The strike side panel 32 overlies the body side panel 34 and the two panels are secured together by the bar tac stitching 33A–33F, FIG. 3,. The plurality of bar tac securement members 33A–33F penetrate through each of the layers 55, FIG. 4, of composite body armor material and each of the woven sheets 36 to secure the composite body side panel 34 and soft body armor strike side panel 32 together forming the multi-component pad 30. The bar tacs 33A–33F are each approximately one inch long and are positioned proximate to the edge 39 of the layers 55 of composite body armor material and the flexible woven sheets 36. As seen in FIG. 3, bar tac 33B is place in the upper right corner, bar tac 33B is placed in the lower right corner, bar tac 33A is place in the upper left corner and bar tac 33E is placed in the lower left corner of the pad 30. Bar tacs 33C and 33F are placed approximately one inch from the edge 39 of the multi-component pad 30.

Figure 5:
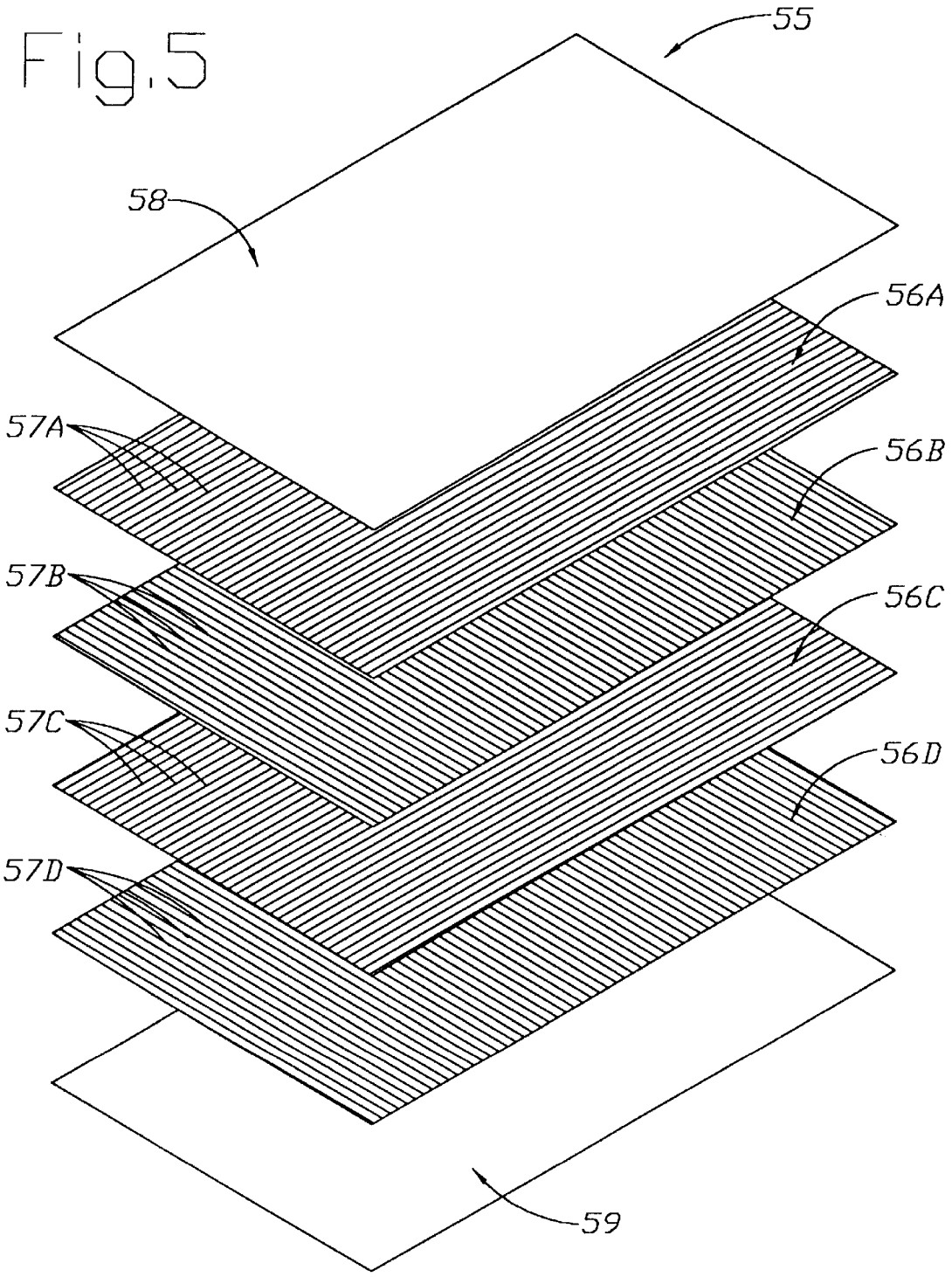
FIG. 5 is an exploded view of the sub-layer plies which compose the individual layers of the composite panel seen as underlying panels in FIGS. 3 and 6, which is illustrative of the orientation of the fibers disposed within a particular ply.

Referring now to FIG. 5, an illustration of an exploded view of a single layer of composite body armor material 55 of the present invention is shown. Each layer 55 is constructed with preferably four sub-layer resin plies 56A, 56B, 56C and 56D which includes a matrix of aqueous thermoplastic and has high tensile strength fibers disposed into each of the plies that extend in the directions illustrated by lines 57A, 57B, 57C and 57D of each respective ply. As can be seen, each successive ply has its high tensile strength fibers extending in a transverse direction to one another. The high tensile strength fibers disposed within a first sub-layer ply of resin 56A, for example, is positioned in a first direction as illustrated by line 57A while the high tensile strength fibers disposed in a second sub-layer ply of resin 56B adjacent the first sub-layer ply are positioned in a direction illustrated by line 57B substantially normal to the fibers in the first sub-layer ply 56A. The preferred construction has four sub-layer plies 56A, 56B, 56C and 56D in which the high tensile strength fibers are disposed into each of the sub-layer plies 56A, 56B, 56C, and 56D. The fibers are positioned, as illustrated by line 57A, 57B, 57C and 57D in a relative orientation of 0, 90, 0, 90 degrees in each successive sub-layer ply. Layers of Goldflex® material sold by Allied Signal, Inc. of Petersburg, Va. are preferably employed as a composite body armor material to form the composite panel.

The high tensile strength fibers utilized in sub-layer plies 56A, 56B, 56C and 56D are preferably aramid. Twaron® T-2000 generally being 1500 denier, 1.5 dpf (denier per filament), manufactured by AKZO NOBEL, Inc. is preferably employed as a fiber impregnated in the resin matrix of the sub-layers of composite material. Alternatively, Kevlar® 129 of 1500 denier manufactured by E. I. Du Pont de Nemours & Co., of Wilmington, Del. may be suitably employed as well as other such fibers with comparable high tensile strength.

With sub-layer resin plies 56A, 56B, 56C and 56D positioned to overlie one another, and with each ply having the high tensile strength fibers oriented in the respective directions 57A, 57B, 57C and 57D, they are cross plied in a 0, 90, 0 and 90 degrees orientation relative to one another. The successive sub-layer plies 56A, 56B, 56C and 56D, are readily fused together through lamination and form a composite body armor layer 55. Sub-layer resin plies 56A, 56B, 56C and 56D are secured together by a laminate covering which is constructed of two sheets 58, 59 of thermoplastic polyethylene film. Sheets 58, 59 enclose and sandwich together sub-layer plies 56A, 56B, 56C and 56D forming a single layer 55 of composite material.

Referring now to FIG. 4, ballistic resistant pad 30 of the ballistic resistant protective garment is shown having the strike face panel 32 and the underlying body side panel 34. To aid in illustrating the individual panels and the sheets herein the sheet securement stitches are not shown in the cross section of FIGS. 4 and 7. The underlying body side panel 34, FIG. 4, is to be worn against the body (preferably at a torso region) of the wearer. It is appreciated that a panel for the back garment section (not shown) has the same properties and structural features as the various embodiments of the front panels described herein. The pad 30 in the embodiment shown in FIG. 4 has a ballistic resistance that prevents projectile penetration for the pad according to National Institute of Justice (NIJ) Standard 0101.03 for Threat Level IIA and preferably has eight overlying sheets 36 of PBO material for the strike side panel 32 and nine overlying layers of plies 55 of composite material for the body side panel 34. In accordance with the present invention the pad 30 in the embodiment of FIG. 4 has a thickness of 0.16 inches and an areal density of 0.65 lbs/ft$^2$. The Threat Level IIA ballistic resistant pad 30 seen in FIG. 4 will stop ballistic penetration from the Winchester 9 mm 127 g SXT and the 250 g .44 Magnum Black Talon while achieving optimum comfort, wearability and performance. Resistance to projectile penetration that meets NIJ Standard 0101.03 certification testing for Threat Level IIA involves a .357 Magnum, 158 grain JSP projectile at 1,250 feet per second (fps) and a 9 mm, 124 grain FMJ RN projectile at 1090 fps.

In an alternative embodiment of bi-component ballistic resistant panel 30 of the present invention which resists projectile penetration meeting NIJ Standards for Threat Level II the pad has eight overlying sheets 36 of woven lyotropic liquid crystal polymer fiber material for the strike side panel 32 and eleven overlying layers 55 of the composite material for the body side panel 34. In accordance with the present invention, the pad 30 in this embodiment has a thickness of 0.18 inches and an areal density of 0.74 lbs/ft$^2$ while maintaining a ballistic resistance that prevents projectile penetration of the pad 30 according to NIJ Standard 0101.03 for Threat Level II. Resistance to projectile penetration that meets NIJ Standard 0101.03 Certification Testing for Threat Level II involves a .357 Magnum, 158 grain JSP projectile at 1,395 feet per second (fps) and a 9 mm, 124 grain FMJ projectile at 1175 fps.

To meet NIJ Standard 0101.03 for Threat Level IIIA, the ballistic resistant pad 30 preferably has eight overlying sheets 36 of woven PBO fiber material for the strike side panel 32 and fifteen overlying layers 55 of composite material for the body side panel 34. In accordance with the present invention, the pad 30 in this embodiment has a thickness of 0.23 inches and an areal density of 0.93 lbs/ft$^2$ while maintaining a ballistic resistance that prevents projectile penetration of the pad according to NIJ Standard 0101.03 for Threat Level IIIA. Resistance to projectile penetration that meets NIJ Standard 0101.03 Certification Testing for Threat Level IIIA involves a .44 Magnum, 240 grain SWC projectile at 1400 feet per second (fps) and a 9 mm, 124 grain FMJ projectile at 1400 fps.

Referring again to FIGS. 3 and 4, the preferred method of making the bi-component ballistic resistant pad 30 to meet NIJ Standard 0101.03 Certification Test Standards for Threat Level IIA involves the step of obtaining eight sheets 36 of woven lyotropic liquid crystal polymer fibers 38 (preferably PBO fibers) in a balanced 30×30 warp to fill ratio per inch plain weave having 99,800,100 filament crossovers per square inch and 900 fiber crossovers per square inch. The step of laying and cutting nine layers or plies 55 of Goldflex® composite body armor material with the same side of the layers always up is also preferred. Using Kevlar® aramid fiber sewing thread, the eight sheets 36 of woven PBO material are sewn together using four stitches per inch. In forming the strike side panel 32 a quilt stitch is made using the Kevlar® sewing thread in which the adjacent parallel rows of stitches 42 and the other crossing rows of stitches 48 are each spaced approximately 1.25 inches apart from each other. The sewn strike side panel 32 having the quilt stitching pattern is placed upon the nine layers of composite material 55. The complete body armor pad 30 is formed by sewing through the entire strike side panel 32 and each of the layers 55 of the body side panel 34 the six bar tacs 33A–33F which are about one inch long or less using the aramid fiber thread. Bar tacs are preferably sewn one at each region proximate a corner 33A, 33B, 33D, 33E of pad 30 and a bar tac proximate each outer arm pit area 33C, 33F. Each sheet 36 of the first panel 32 and each layer 55 of the second panel 34 have substantially the same length and width dimensions.

The completed bi-component pad 30 has a thinness no greater than 0.16 inches and an areal density no greater than 0.65 lbs/ft$^2$ while meeting NIJ 0101.03 Standard Testing specifications for Threat Level IIA. The pad 30 is placed within a pad cover 22 preferably constructed of Gore-tex® material or ripstop nylon with a urethane coating. The pad 30 is placed in the cover 22 with the strike side panel 32 facing outside and the pad cover 22 is closed with a seam at its bottom. The pad cover 22 covers and encloses the pad 30 in which the pad cover is substantially the same shape as the pad thereby providing a snug fit.

The steps for constructing a bi-component pad 30 having a projectile penetration resistance meeting 0101.03 NIJ Standard test specifications for Threat Level II are substantially the same as those for Threat Level IIA except eleven layers 55 of composite body armor material are employed for the body side panel 34. The pad 30 for Threat level II has a thinness no greater than 0.18 inches and an areal density no greater than 0.74 lbs/ft$^2$. Additionally, the steps for constructing the bi-component pad of the present invention having a projectile penetration resistance meeting NIJ specifications for Threat Level IIIA are substantially the same as those stated above for Threat Level IIA except fifteen layers 55 of composite body armor material are employed for the body side panel 34. The pad 30 for Threat Level IIIA has a thinness no greater than 0.23 inches and an areal density no greater than 0.93 lbs/ft$^2$.

Figure 7:
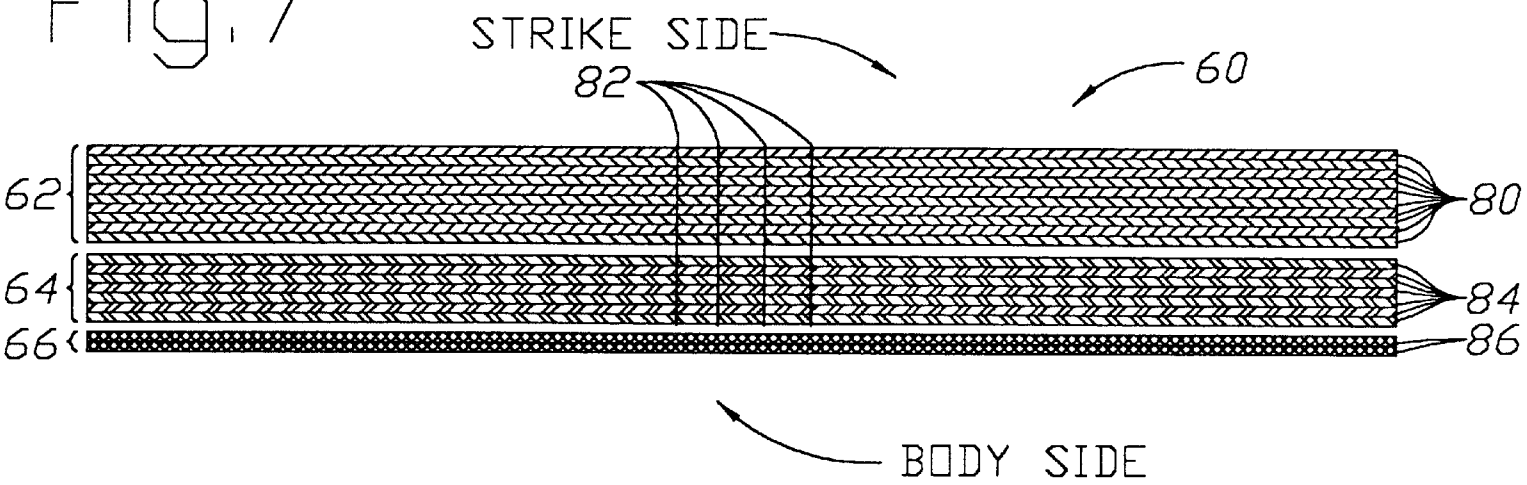
FIG. 7 is a cross sectional view taken along line 7—7 of FIG. 6.
Figure 6:
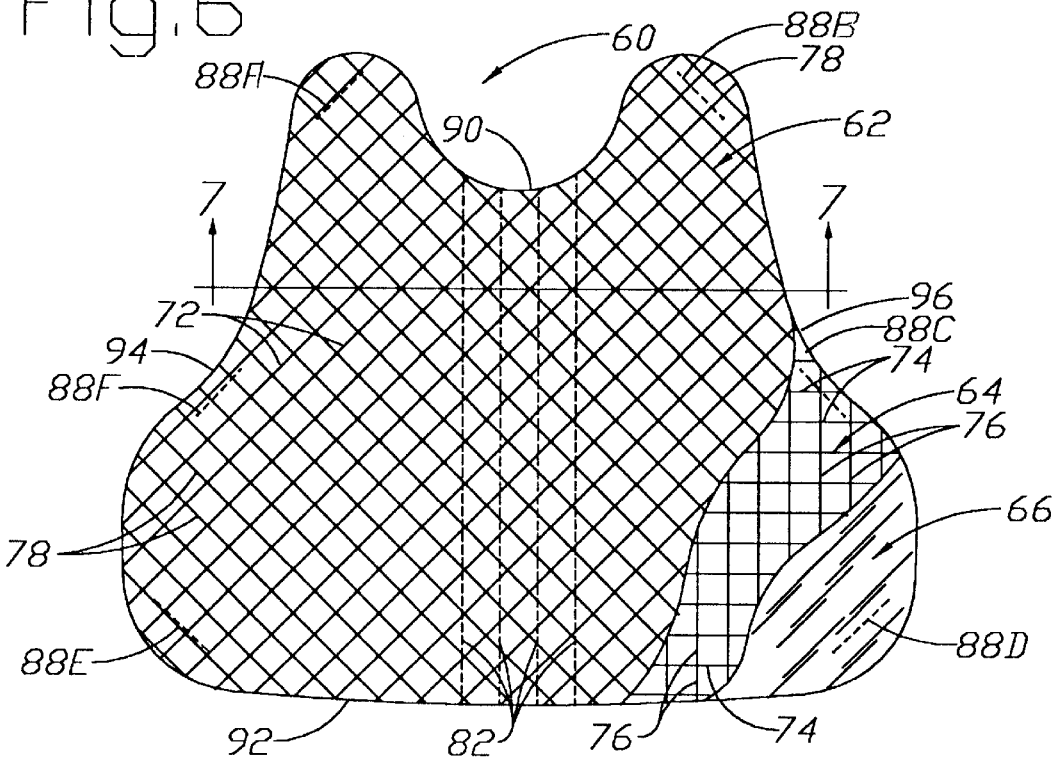
FIG. 6 is a plan view of alternative embodiment of the ballistic resistant pad of the present invention.

Referring now to the FIGS. 6 and 7, an alternative embodiment of a ballistic resistant pad 60 of tri-component construction is shown. The tri-component ballistic resistant pad 60 has at least three panels 62, 64, 66 each constructed of different types of high strength penetration resistant materials. The first panel 62 positioned at the strike side of the pad 60 is constructed of a plurality of overlying layered sheets 80 formed from a weave of a first type of high strength woven fibers, preferably para phenylene terathalamid high tensile strength aramid fibers made by AKZO NOBEL, Inc. sold under the trademark Twaron®, and in particular Twaron T-2000 microfilament fibers. The sheets 80 of Twaron T-2000 woven material are secured together to form the first strike side panel 62 by multiple crossing rows 72, 78 of stitching forming a quilt pattern of stitches on panel 62. The sheets 80 may alternatively be constructed of Kevlar® or other suitable high tensile strength aramid fibers.

The second, preferably intermediate, panel 64, FIGS. 6, 7, is constructed of a plurality of overlying layered sheets 84 formed from a weave of fibers constructed of lyotropic liquid crystal polymer material. The rigid-rod lyotropic liquid crystal polymer fiber preferably employed is poly(p-phenylene-2,6-benzobisoxazole) also called PBO developed by Toyobo Co. Inc. of Osaka, Japan and sold under trademark Zylon®. The fiber and weave characteristics of the sheets 84 of woven PBO material are the same as those in the bi-component embodiment as described in FIG. 8. The third panel or body side panel 66, FIGS. 6 and 7, of the tri-component pad 60 is constructed of a plurality of overlying layers 86 of composite body armor material. As seen in FIGS. 6 and 7, the first panel 62, second panel 64 and third panel 66 of the pad 60 are positioned in overlying relationship to one another.

Figure 9:
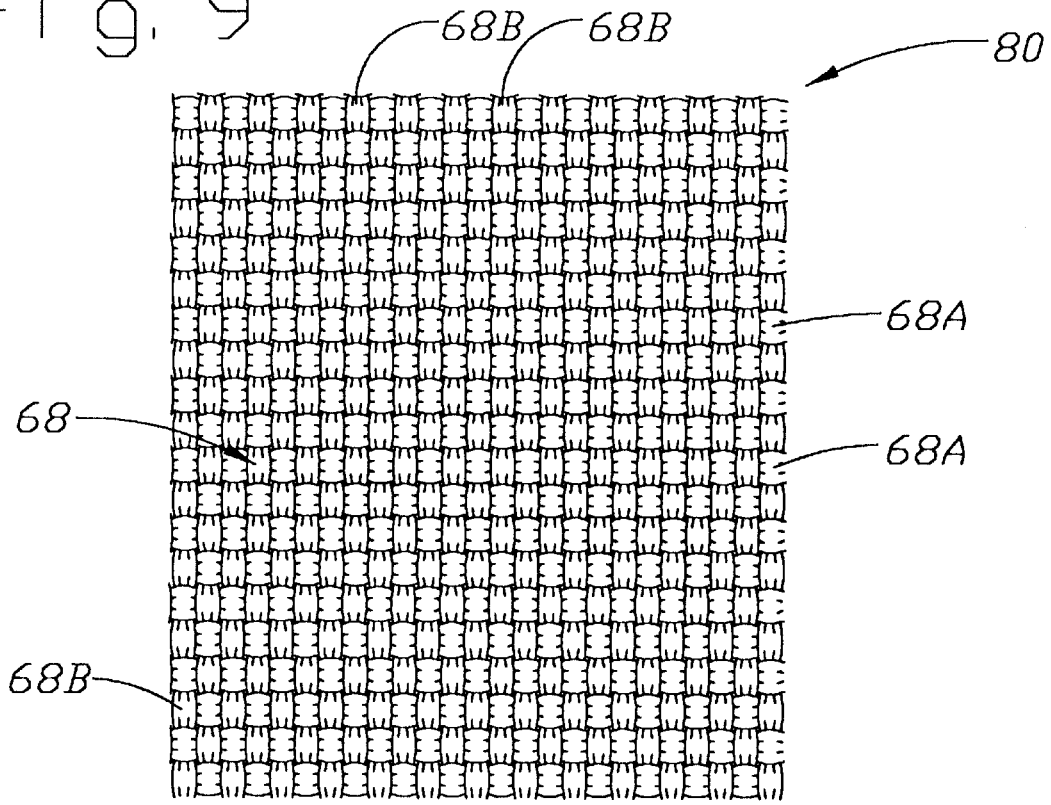
FIG. 9 is an enlarged partial view representative of an imbalanced weave of a sheet of woven aramid fibers of the present invention.

Referring ahead to FIG. 9 an enlarged partial view representative of the imbalanced weave of a sheet 80 of woven aramid fibers of the first panel 62 is shown. The weave for the sheets 80 constructed preferably of Twaron® T-2000 microfilament fibers 68 has a warp to fill ratio of 24 by 22 fibers per inch. There are 24 horizontal warp fibers 68A, FIG. 9, and 22 fill fibers 68B per inch for each sheet 80 of woven para phenylene terathalamide fiber 68.

Referring again to FIGS. 6 and 7, the intermediate panel 64 is formed of a plurality of woven sheets 84 of rigid-rod lyotropic liquid crystal polymer fibers. Each of the woven overlying sheets 84, FIG. 7, are preferably constructed of a rigid-rod lyotropic liquid crystal polymer fiber formed from poly(p-phenylene-2,6-benzobisoxazole) (PBO) developed by Toyobo Co. Ltd. of Osaka, Japan and sold under the trademark ZYLON®. The high strength and low insulating poly(p-phenylene-2,6-benzobisoxazole) (PBO) fiber woven in to the sheets 84 and incorporated into the second intermediate ballistic resistant panel 64 further enables the pad 60 to provide high penetration resistance while being thin, lightweight, flexible and cool thereby enhancing the wearability of the garment. The lyotropic liquid crystal polymer fiber material has a filament denier of 1.5 dpf (denier(g/9000 m) per filament) and a density ranging from 1.54 to 1.56 g/cm$^3$. Denier is a measure of grams per 9000 meters (g/9000). The PBO fiber preferably employed in panel 64 has a tensile strength at 42 grams/denier and 840 KSI (thousand pounds per square inch). Additionally, the preferred PBO fiber has a tensile modulus ranging from 1300 to 2000 grams/denier and a decomposition temperature in air of 650 degrees centigrade. The elongation at break for the lyotropic liquid crystal polymer fiber 38 ranges from 2.5 percent to 3.5 percent.

As seen in FIG. 7, pad 60 has its strike side panel 62 of woven aramid material and its intermediate panel 64 of woven PBO fibers 68, FIG. 9, each having a plurality of overlying layered sheets 80, 84. As seen in FIG. 6, a plurality of sheet securement stitches 72 are disposed into the strike side panel 62 connecting the plurality of sheets 80 together within the strike side panel. At least one row, and preferably a plurality of rows of sheet securement stitches 72 are aligned in a first direction at the first panel 62. The rows of sheet securement stitches 72 in the first direction are disposed only in the strike side panel 62 and are employed to connect together the woven sheets 80 of Twaron® T-2000 material to form the strike side panel.

Another plurality of sheet securement stitches 74, 76 which are disposed only in the second underlying intermediate panel 64 constructed of woven PBO fibers 38, FIG. 9, likewise only connect the woven sheets of the intermediate panel 64, FIG. 7. These other sheet securement stitches are positioned in a plurality of at least two rows 74, 76, FIG. 6, in which the plurality of securement stitching rows 74, 76 are aligned in a second (generally vertical) and a third (generally horizontal) direction respectively. The second and third directions of the rows of sheet securement stitches 74 and 76 are transverse to one another. Additionally, row 72 of stitching in the first direction across the strike side panel 62 is transverse to the two other rows of stitches 74, 76 positioned in the aforementioned second or third directions across the second or middle panel 64.

The rows of stitches 72 in the strike side panel 62 and the rows of stitches 74, 76 of the intermediate panel are both composed of high strength penetration resistant fibers such as aramid fibers such as Kevlar® developed by E. I. DuPont de Nemours & Company of Wilmington, Del. Other high strength penetration resistant fibers providing improvements may suitably be found through the employment of Spectra® fiber made by Allied Signal & Co. of Morris County, N.J., or a rigid-rod lyotropic liquid crystal polymer fiber formed from poly(p-phenylene-2,6-benzobisoxazole) (PBO) developed by Toyobo Co. Ltd. of Osaka, Japan and sold under the trademark ZYLON®.

As seen in FIG. 6, the plurality of stitching rows 72 securing the sheets 80 of strike side panel 62 are spaced apart and are substantially parallel to one another in the first direction. Also seen in FIG. 6, the strike side panel 62 further includes a plurality of other crossing rows of sheet securement stitches 78 spaced apart from one another and substantially parallel to one another in which the rows 72 of stitches in the first direction and the plurality of other rows 78 securing the sheets 80 of woven aramid ballistic resistant material are transverse to one another and in this embodiment substantially perpendicular to one another. Moreover, the rows of sheet securement stitches 72, 78 of first (strike side) panel 62 each extend substantially across first panel 62. The rows of sheet securement stitches 72, 78 of first strike side panel 62 form a pattern of quilt stitches in the strike side panel 62.

In referring to the second or intermediate panel 64, as seen in FIG. 6, the rows of sheet securement stitches 74 are spaced apart from one another, are substantially parallel to one another and are positioned in a second direction, or preferably a generally vertical direction. Second panel 64 further has another plurality of rows of sheet securement stitches 76 spaced apart from one another which are substantially parallel to one another and are positioned in a third direction, preferably a generally horizontal direction. The generally vertical rows of stitches 74 and the generally horizontal rows of stitches 76 are preferably positioned substantially perpendicular to one another, as seen in FIG. 6. Rows of stitches 74, 76 of the second panel 64 each extend substantially across the panel 64. As a result, in this embodiment the plurality of the rows of stitches 74, 76 of body side panel 64 form a pattern of box stitches.

These plurality of rows of sheet securement stitches 72, 78 and 74, 76 are preferably all composed of a high tensile strength fiber such as an aramid (Kevlar® or Twaron®). In accordance with the present invention other high strength protective fibers such as poly(p-phenylene-2,6-benzobisoxazole) fibers of Spectra® fibers may suitably be employed as sheet securement stitches 72, 74, 76, 78. Preferably, aramids, PBO or Spectra® fibers are employed as the stitching material to hold together the ballistic resistant woven layered sheets 80, 84. The sheet securement stitches 72, 78 are completely disposed through each of the ballistic resistant sheets 80 to form and establish strike side panel 62. In similar fashion, the second middle panel 64 is formed by the box stitching pattern of sheet securement stitches 74, 76 which only connect the ballistic resistant sheets 84 of panel 64 together. Individual panels may alternatively be formed by other suitable securement approaches such as stitching about the periphery of ballistic resistant sheets, bar tacs, non-invasive securement of the layered sheets and the like.

As shown in FIG. 6, first panel 62 may selectively contain a pattern of quilt stitches 72, 78 positioned substantially across strike side panel 62 and panel 64 may selectively contain a pattern of box stitches 74, 76 positioned substantially across panel 64. As discussed in more detail in U.S. Pat. No. 5,479,659 entitled "Lightweight Ballistic Resistant Garments And Method To Produce The Same" issued Jan. 2, 1996 to Bachner, Jr. assigned to the assignee of the present invention and which is hereby incorporated by reference herein, these stitching patterns in the different panels 62, 64 which overlie and are adjacent to one another provide transference of energy at time of impact by a bullet or other projectile force.

Referring again to FIGS. 6 and 7, at least one row of multi-panel securement stitches 82 are disposed through the first panel 62 and second panel 64. Preferably, four rows of multi-panel securement stitches 82 extend in a substantially vertical direction between a top edge 90 and a bottom edge 92 of the strike side and intermediate panels 62, 64. As seen in FIG. 6, stitches 82 extend from the top to bottom edges 90, 92 of the first and second panels 62, 64. As seen in FIG. 7, the multi-panel securement stitches 82 are disposed only through just the first and second panels 62, 64. The four rows of multi-panel securement stitches 82 are positioned between a right edge 96 and a left edge 94 of the panels 62, 64. The four rows of stitches 82 are spaced apart and are substantially parallel to one another.

As seen in FIG. 7, the third or body side panel 66 has a plurality of layers 86 of composite body armor material. Preferably, the layers 86 of composite body armor material are plies of GoldFLex® material sold by Allied Signal, Inc. of Petersburg, Va, however other suitable composite body armor material may be selectively employed. Reference can made to FIG. 5 for the characteristics of the individual layers 86 of composite body armor material (which are the same as those referenced as numeral 55 for the bi-component pad embodiment) of the body side panel 66 of the tri-component pad 60 embodiment.

As seen in FIG. 6, the protective tri-component body armor pad 60 has a plurality of bar tac stitches 88A–88F positioned in the peripheral area of the protective pad securing the first panel 62, second panel 64, and third panel 66 together. At least four rows of bar tac stitching may suitably be employed, however six bar tac stitches 88A–88F of Kevlar® thread are preferably employed. Each of the rows of bar tac stitching 88A–88F are no longer than one inch in length with one bar tac positioned at each of the four corners 88A, 88B, 88D, 88E of the pad 60 and one at each outer armpit area 88C, 88F. The first, second and third panels 62, 64, 66 are secured together substantially in alignment to one another by bar tacs 88A–88F. As seen in FIGS. 6 and 7, preferably the first aramid fiber panel 62 is positioned on the strike side of the pad 60, the third composite material panel 66 is positioned on the body side of the pad and the second (PBO) panel 64 is positioned intermediate the first and second panels.

Referring now to FIG. 7, embodiment of the tri-component ballistic resistant pad 60 of the ballistic resistant protective garment is shown having the first strike face panel 62, second intermediate panel 64 and the underlying body side panel 66. The underlying body side panel 66, FIG. 4, is to be worn against the body (preferably at a torso region) of the wearer. It is appreciated that a panel for the back garment section (not shown) has the same properties and structural features as the various embodiments of the front panels described herein. The pad 60 in the embodiment shown in FIG. 7 has a ballistic resistance that prevents projectile penetration for the pad according to National Institute of Justice (NIJ) Standard 0101.03 for Threat Level IIA and preferably has ten overlying sheets 80 of woven Twaron® T-2000 or aramid material for the strike side panel 62 seven sheet plies 84 of woven PBO material in the second panel 64 and two overlying layers of plies 86 of composite material for the body side panel 66. In accordance with the present invention the pad 60 in the embodiment of FIG. 7 has a thickness of 0.16 inches and an areal density of 0.63 lbs/ft$^2$. The Threat Level IIA ballistic resistant pad 60 seen in FIG. 7 will stop ballistic penetration from the Winchester 9 mm 127 g SXT and the 250 g .44 Magnum Black Talon while achieving optimum comfort, wearability and performance. Resistance to projectile penetration that meets NIJ Standard 0101.03 certification testing for Threat Level IIA involves a .357 Magnum, 158 grain JSP projectile at 1,250 feet per second (fps) and a 9 mm, 124 grain FMJ RN projectile at 1090 fps.

In an alternative embodiment of tri-component ballistic resistant panel 60 of the present invention which resists projectile penetration meeting NIJ Standards for Threat Level II the pad has twelve overlying sheets 80 of woven aramid fiber material for the strike side panel 62, seven sheets 84 of woven PBO material in the second middle panel 64 and three overlying layers 86 of the composite material for the body side panel 66. In accordance with the present invention, the tri-component pad 60 in this embodiment has a thickness of 0.19 inches and an areal density of 0.74 lbs/ft$^2$ while maintaining a ballistic resistance that prevents projectile penetration of the pad 60 according to NIJ Standard 0101.03 for Threat Level II. Resistance to projectile penetration that meets NIJ Standard 0101.03 Certification Testing for Threat Level II involves a .357 Magnum, 158 grain JSP projectile at 1,395 feet per second (fps) and a 9 mm, 124 grain FMJ projectile at 1175 fps.

To meet NIJ Standard 0101.03 for Threat Level IIIA, the ballistic resistant pad 60 preferably has fifteen overlying sheets 80 of woven Twaron® (para phenylene terathalamide) material for the strike side panel 62, seven sheets 84 of woven PBO fiber material for the second intermediate panel 64 and five overlying layers 86 of composite material for the body side panel 66. In accordance with the present invention, the pad 60 in this embodiment has a thickness of 0.24 inches and an areal density of 0.94 lbs/ft$^2$ while maintaining a ballistic resistance that prevents projectile penetration of the pad according to NIJ Standard 0101.03 for Threat Level IIIA. Resistance to projectile penetration that meets NIJ Standard 0101.03 Certification Testing for Threat Level IIIA involves a .44 Magnum, 240 grain SWC projectile at 1400 feet per second (fps) and a 9 mm, 124 grain FMJ projectile at 1400 fps.

Referring again to FIGS. 6 and 7, the preferred method of making the tri-component ballistic resistant pad 60 to meet NIJ Standard 0101.03 Certification Test Standards for Threat Level IIA involves the steps of obtaining seven sheets 84 of woven lyotropic liquid crystal polymer fibers 38 (preferably PBO fibers) in a balanced 30×30 warp to fill ratio per inch plain weave having 99,800,100 filament crossovers per square inch and 900 fiber crossovers per square inch. The step of obtaining ten woven sheets 80 having an imbalanced 24 by 22 weave of Twaron® T-2000 aramid fibers is also performed. The step of laying and cutting two layers or plies 86 of Goldflex® composite body armor material with the same side of the layers always up is also preferred.

Using Kevlar® aramid fiber sewing thread, the ten sheets 80 of woven aramid fiber are sewn together using four stitches per inch. In forming the strike side panel 62 a quilt stitch is made using the Kevlar® sewing thread in which the adjacent parallel rows of stitches 72 and the other crossing rows of stitches 78 are each spaced approximately 1.25 inches apart from each other. The Kevlar® sewing thread is used in performing the step of sewing the box stitch pattern across the middle sheets 84 of woven PBO fibers with adjacent parallel rows of stitches 74, 76 each spaced approximately 1.25 inches from each other. The sewn strike side panel 62 having the quilt stitching pattern is placed upon the sewn middle panel 64 having the box stitch pattern. The strike face panel 62 and the middle panel 64 only are sewn together with four vertical seams 82 centered on the pad 60. The sewn together strike side panel 62 and second middle panel 64 are placed on the two layers of composite body armor material 86. The complete body armor pad 60 is formed by sewing, through the entire strike side panel 62 and middle panel 64 and each of the layers 86 of the body side panel 66, the six bar tacs 88A–88F which are about one inch long or less using the aramid fiber thread. Bar tacs are preferably sewn one at each region proximate a corner 88A, 88B, 88D, 88E of pad 60 and a bar tac proximate each outer arm pit area 88C, 88F.

The completed tri-component pad 60 has a thinness no greater than 0.16 inches and an areal density no greater than 0.63 lbs/ft$^2$ while meeting NIJ 0101.03 Standard Testing specifications for Threat Level IIA. The pad 60 is placed within a pad cover 22 preferably constructed of Gore-tex® material, White Supplex® material or ripstop nylon with a urethane coating. The pad 60 is placed in the cover 22 with the strike side panel 62 facing outside and the pad cover 22 is closed with a seam at its bottom. The pad cover 22 covers and encloses the pad 30 in which the pad cover is substantially the same shape as the pad thereby providing a snug fit.

The steps for constructing a tri-component pad 60 having a projectile penetration resistance meeting 0101.03 NIJ Standard test specifications for Threat Level II are substantially the same as those for Threat Level IIA except twelve sheets 80 of woven aramid material are used at the strike face panel 62, seven sheets 84 of woven PBO material are used in the middle panel 64 and three layers of composite body armor material are employed for the body side panel 66. The pad 60 for Threat level II has a thinness no greater than 0.19 inches and an areal density no greater than 0.74 lbs/ft$^2$. Additionally, the steps for constructing the tri-component pad of the present invention having a projectile penetration resistance meeting NIJ specifications for Threat Level IIIA are substantially the same as those stated above for Threat Level IIA except fifteen sheets 80 of woven aramid fiber material are used at the strike face panel 62, seven sheets 84 of woven PBO material are used in the middle panel 64 and five layers of composite body armor material are employed for the body side panel 66. The pad 60 for Threat Level IIIA has a thinness no greater than 0.24 inches and an areal density no greater than 0.94 lbs/ft$^2$.

The employment of a panel of layered sheets of PBO fibers in both the bi-component and the tri-component pads 30, 60 of the present invention introduces a synergistic effect with the ballistic resistant materials of the other panels. The synergistic effect enhances the anti-ballistic performance of the high strength material of the other panels through increased lateral energy dispersion, reduces bunching and balling of the pad in an NIJ laboratory test environment and further improves blunt trauma performance.

While a detailed description of the preferred embodiment of the invention has been given, it should be appreciated that many variations can be made thereto without departing from the scope of the invention as set forth in the appended claims.

What is claimed is:

1. A ballistic resistant protective garment comprising:

a ballistic resistant pad having at least two panels;

a first panel constructed of a plurality of overlying layered sheets constructed of woven lyotropic liquid crystal polymer fiber positioned at a strike side of the pad; and a second panel constructed of a plurality of overlying layers of sheets of composite body armor material positioned at a body side of the pad in which the first panel overlies and is secured with stitches to the second panel and in which the first and second panels are held together in alignment to one another.

2. The ballistic resistant protective garment of claim 1 in which the sheets of the first panel are constructed of a rigid-rod lyotropic liquid crystal polymer fiber.

3. The ballistic resistant protective garment of claim 2 in which the rigid-rod lyotropic liquid crystal polymer fiber is formed from poly(p-phenylene-2,6-benzobisoxazole).

4. The ballistic resistant protective garment of claim 1 in which the lyotropic liquid crystal polymer fiber has a filament denier of 1.5 dpf (denier per filament).

5. The ballistic resistant protective garment of claim 1 in which the lyotropic liquid crystal polymer fiber has a density ranging from 1.54 to 1.56 g/cm$^3$.

6. The ballistic resistant protective garment of claim 1 in which the lyotropic liquid crystal polymer fiber has a tensile strength of 42 grams/denier and 840 KSI.

7. The ballistic resistant protective garment of claim 1 in which the lyotropic liquid crystal polymer fiber has a tensile modulus ranging from 1300 to 2000 grams/denier.

8. The ballistic resistant protective garment of claim 1 in which the lyotropic liquid crystal polymer fiber has a decomposition temperature in air of 650 degrees centigrade.

9. The ballistic resistant protective garment of claim 1 in which the elongation at break for the lyotropic liquid crystal polymer fiber ranges from 2.5 percent to 3.5 percent.

10. The ballistic resistant protective garment of claim 1 includes a plurality of stitches disposed into the first panel connecting the plurality of sheets together within the first panel in which the plurality of stitches includes at least one row of stitches aligned in a first direction and at least one other row of stitches aligned in a second direction in which the row of stitches in the first and second directions are transverse to one another.

11. The ballistic resistant protective garment of claim 10 in which the plurality of stitches are disposed in the first panel only.

12. The ballistic resistant protective garment of claim 10 in which the plurality of stitches are composed of an aramid fiber.

13. The ballistic resistant protective garment of claim 10 in which the at least one row of stitches includes a plurality of rows of stitches substantially parallel to one another and spaced apart from one another and in which the at least one other row of stitches includes a plurality of other rows of stitches substantially parallel to one another and spaced apart from one another.

14. The ballistic resistant protective garment of claim 13 in which the rows of stitches and the other rows of stitches in the first panel are substantially perpendicular to one another.

15. The ballistic resistant protective garment of claim 14 in which the plurality of rows and the other plurality of rows of stitches of the first panel each extend substantially across the first panel.

16. The ballistic resistant protective garment of claim 14 in which the plurality of rows of stitches and the other plurality of rows of stitches of the first panel form a pattern of quilt stitches in the first panel.

17. The ballistic resistant protective garment of claim 1 including a pad cover for covering and enclosing the pad in which the pad cover is substantially the same shape as the pad.

18. The ballistic resistant protective garment of claim 17 in which the pad cover is constructed at least in part of water proof material.

19. The ballistic resistant protective garment of claim 1 in which the lyotropic liquid crystal polymer fibers are woven in a balanced weave to form the layered sheets in the first panel.

20. The ballistic resistant protective garment of claim 19 in which the weave for the sheets constructed of lyotropic liquid crystal polymer fiber has a warp to fill ratio of 30 by 30 fibers per inch.

21. The ballistic resistant protective garment of claim 1 in which each sheet of the first and second panels of the ballistic resistant pad have substantially the same length and width dimensions and substantially the same thickness.

22. A ballistic resistant protective garment comprising:

a ballistic resistant pad having at least two panels;

a first panel constructed of a plurality of overlying layered sheets constructed of woven lyotropic liquid crystal polymer fiber positioned at a strike side of the pad;

a second panel constructed of a plurality of overlying layers of sheets of composite body armor material positioned at a body side of the pad in which the first panel overlies the second panel and in which the first and second panels are held together in alignment to one another;

a pad cover covering and enclosing the pad in which the pad cover is substantially the same shape as the pad; and an outer carrier for enclosing and carrying the padded pad cover and for supporting the covered pad against the body of the wearer.

23. A ballistic resistant protective garment comprising:

a ballistic resistant pad having at least two panels;

a first panel constructed of a plurality of overlying layered sheets constructed of woven lyotropic liquid crystal polymer fiber positioned at a strike side of the pad; and a second panel constructed of a plurality of overlying layers of sheets of composite body armor material positioned at a body side of the pad in which the first panel overlies the second panel and in which the first and second panels are held together in alignment to one another and in which each of the plurality of overlying layers of composite body armor material in the second panel is constructed of a plurality of sub-layer resin plies in which each ply has a high tensile strength fiber extending and disposed therein, in which the high tensile strength fiber of one ply extends transverse to the high tensile strength fiber of an adjacent ply and a laminate covering to enclose and sandwich together the sub-layer plies of resin and high tensile strength fiber forming a single layer of the plurality of layers of the second panel.

24. The ballistic resistant protective garment of claim 23 in which the high tensile strength fibers extending and disposed in the sub-layer resin plies is an aramid.

25. The ballistic resistant protective garment of claim 24 in which the high tensile strength fibers are generally 1500 denier.

26. The ballistic resistant protective garment of claim 23 in which the sub-layer resin plies are constructed of an aqueous thermoplastic.

27. The ballistic resistant protective garment of claim 23 in which the laminate covering includes thermoplastic polyethylene film.

28. The ballistic resistant protective garment of claim 23 includes four sub-layer plies.

29. The ballistic resistant protective garment of claim 23 in which the high tensile strength fibers disposed within a first sub-layer ply of resin is positioned in a first direction and the high tensile strength fibers disposed in a second sub-layer ply of resin adjacent the first sub-layer ply are positioned in a direction substantially normal to the high tensile strength fibers in the first sub-layer ply.

30. The ballistic resistant protective garment of claim 29 including four sub-layer plies in which the high tensile strength fibers are positioned in a relative orientation of 0, 90, 0, 90 degrees in each successive sub-layer ply.

31. A ballistic resistant protective garment comprising:

a ballistic resistant pad having at least two panels;

a first panel constructed of a plurality of overlying layered sheets constructed of woven lyotropic liquid crystal polymer fiber positioned at a strike side of the pad;

a second panel constructed of a plurality of overlying layers of sheets of composite body armor material positioned at a body side of the pad in which the first panel overlies the second panel and in which the first and second panels are held together in alignment to one another; and at least one row of bar tac stitching positioned in the peripheral area of the protective pad securing the first and second panel together.

32. The ballistic resistant protective garment of claim 31 in which the at least one row of bar tac stitching includes at least four rows of bar tac stitching.

33. The ballistic resistant protective garment of claim 31 in which each of the rows of bar tac stitching is no longer than one inch in length.

34. A ballistic resistant protective garment comprising:

a ballistic resistant pad having at least two panels;

a first panel constructed of a plurality of overlying layered sheets constructed of woven lyotropic liquid crystal polymer fiber positioned at a strike side of the pad; and a second panel constructed of a plurality of overlying layers of sheets of composite body armor material positioned at a body side of the pad in which the first panel overlies the second panel and in which the first and second panels are held together in alignment to one another in which there are no more than eight sheets in the first panel and no more than nine layers in the second panel and in which the pad formed by the first and second panels has an areal density not greater than 0.65 lbs/ft$^2$ and a thickness not greater than 0.16 inches having a ballistic resistance that prevents projectile penetration of the ballistic resistant pad according to NIJ Standard 0101.03 for Threat Level IIA.

35. A ballistic resistant protective garment comprising:

a ballistic resistant pad having at least two panels;

a first panel constructed of a plurality of overlying layered sheets constructed of woven lyotropic liquid crystal polymer fiber positioned at a strike side of the pad; and a second panel constructed of a plurality of overlying layers of sheets of composite body armor material positioned at a body side of the pad in which the first panel overlies the second panel and in which the first and second panels are held together in alignment to one another in which there are no more than eight sheets in the first panel and no more than eleven layers in the second panel and in which the first panel overlies the second panel and in which the pad formed by the first and second panels has an areal density not greater than 0.74 lbs/ft$^2$ and a thickness not greater than 0.18 inches having a ballistic resistance that prevents projectile penetration of the ballistic resistant pad according to NIJ Standard 0101.03 for Threat Level II.

36. A ballistic resistant protective garment comprising:

a ballistic resistant pad having at least two panels;

a first panel constructed of a plurality of overlying layered sheets constructed of woven lyotropic liquid crystal polymer fiber positioned at a strike side of the pad; and a second panel constructed of a plurality of overlying layers of sheets of composite body armor material positioned at a body side of the pad in which the first panel overlies the second panel and in which the first and second panels are held together in alignment to one another in which there are no more than eight sheets in the first panel and no more than fifteen layers in the second panel and in which the pad formed by the first and second panels has an areal density not greater than 0.93 lbs/ft$^2$ and a thickness not greater than 0.23 inches having a ballistic resistance that prevents projectile penetration of the ballistic resistant pad according to NIJ Standard 0101.03 for Threat Level IIIA.

37. A ballistic resistant protective garment, comprising:

a first panel constructed of a plurality of overlying layered sheets constructed of woven lyotropic liquid crystal polymer fibers; and a second panel constructed of a plurality of overlying layers of composite body armor material in which the first panel overlies the second panel to form a pad and the first panel is positioned at a strike side of the pad and the second panel is positioned at a body side of the pad and in which the pad has an areal density not greater than 0.65 lbs/ft$^2$ and has a ballistic resistance that prevents projectile penetration of the ballistic resistant pad according to NIJ Standard 0101.03 for Threat Level IIA.

38. A ballistic resistant protective garment, comprising:

a first panel constructed of a plurality of overlying layered sheets constructed of woven lyotropic liquid crystal polymer fiber; and a second panel constructed of a plurality of overlying layers of composite body armor material in which the first panel overlies the second panel to form a pad and the first panel is positioned at a strike side of the pad and the second panel is positioned at a body side of the pad and in which the pad has a thickness not greater than 0.16 inches and has a ballistic resistance that prevents projectile penetration of the ballistic resistant pad according to NIJ Standard 0101.03 for Threat Level IIA.

39. A ballistic resistant protective garment, comprising:

a first panel constructed of a plurality of overlying layered sheets constructed of woven lyotropic liquid crystal polymer fiber; and a second panel constructed of a plurality of overlying layers of composite body armor material in which the first panel overlies the second panel to form a pad and the first panel is positioned at a strike side of the pad and the second panel is positioned at a body side of the pad and in which the pad has an areal density not greater than 0.74 lbs/ft$^2$ and has a ballistic resistance that prevents projectile penetration of the ballistic resistant pad according to NIJ Standard 0101.03 for Threat Level II.

40. A ballistic resistant protective garment, comprising:

a first panel constructed of a plurality of overlying layered sheets constructed of woven lyotropic liquid crystal polymer fiber; and a second panel constructed of a plurality of overlying layers of composite body armor material in which the first panel overlies the second panel to form a pad and the first panel is positioned at a strike side of the pad and the second panel is positioned at a body side of the pad and in which the pad has a thickness not greater than 0.18 inches and has a ballistic resistance that prevents projectile penetration of the ballistic resistant pad according to NIJ Standard 0101.03 for Threat Level II.

41. A ballistic resistant protective garment, comprising:

a first panel constructed of a plurality of overlying layered sheets constructed of woven lyotropic liquid crystal polymer fiber; and a second panel constructed of a plurality of overlying layers of composite body armor material in which the first panel overlies the second panel to form a pad and the first panel is positioned at a strike side of the pad and the second panel is positioned at a body side of the pad and in which the pad has an areal density not greater than 0.93 lbs/ft$^2$ and has a ballistic resistance that prevents projectile penetration of the ballistic resistant pad according to NIJ Standard 0101.03 for Threat Level IIIA.

42. A ballistic resistant protective garment, comprising:

a first panel constructed of a plurality of overlying layered sheets constructed of woven lyotropic liquid crystal polymer fiber; and a second panel constructed of a plurality of overlying layers of composite body armor material in which the first panel overlies the second panel to form a pad and the first panel is positioned at a strike side of the pad and the second panel is positioned at a body side of the pad and in which the pad has a thickness not greater than 0.23 inches and has a ballistic resistance that prevents projectile penetration of the ballistic resistant pad according to NIJ Standard 0101.03 for Threat Level IIIA.

43. A ballistic protective garment comprising:

a ballistic resistant pad having at least three panels;

a first panel constructed of a plurality of overlying layered sheets formed from a weave of a first type of high tensile strength fibers, said fibers being aramid fibers which are woven into an imbalanced weave;

a second panel constructed of a plurality of overlying layers of sheets formed from a weave of fibers constructed of lyotropic liquid crystal polymer material; and a third panel constructed of a plurality of overlying layers of composite body armor material in which the first, second and third panels of the pad are in overlying relationship to one another.

44. The ballistic resistant garment of claim 43 in which the aramid is Para Phenylene Terathalamide.

45. The ballistic resistant garment of claim 43 in which the imbalance weave has a warp to fill ratio of 24 by 22.

46. The ballistic resistant protective garment of claim 43 in which the sheets of the second panel are constructed of a rigid-rod lyotropic liquid crystal polymer fiber.

47. The ballistic resistant protective garment of claim 46 in which the rigid-rod lyotropic liquid crystal polymer fiber is formed from poly(p-phenylene-2,6-benzobisoxazole).

48. The ballistic resistant protective garment of claim 43 in which the lyotropic liquid crystal polymer fiber has a filament denier of 1.5 denier per foot.

49. The ballistic resistant protective garment of claim 43 in which the lyotropic liquid crystal polymer fiber has a density ranging from 1.54 to 1.56 g/cm$^3$.

50. The ballistic resistant protective garment of claim 43 in which the lyotropic liquid crystal polymer fiber has a tensile strength of 42 grams/denier and 840 KSI.

51. The ballistic resistant protective garment of claim 43 in which the lyotropic liquid crystal polymer fiber has a tensile modulus ranging from 1300 to 2000 grams/denier.

52. The ballistic resistant protective garment of claim 43 in which the lyotropic liquid crystal polymer fiber has a decomposition temperature in air of 650 degrees centigrade.

53. The ballistic resistant protective garment of claim 43 in which the elongation at break for the lyotropic liquid crystal polymer fiber ranges from 2.5 percent to 3.5 percent.

54. The ballistic resistant protective garment of claim 43 in which the lyotropic liquid crystal polymer fibers are woven in a balanced weave to form the layered sheets in the second panel.

55. The ballistic resistant protective garment of claim 54 in which the weave for the sheets constructed of lyotropic liquid crystal polymer fiber has a warp to fill ratio of 30 by 30 fibers per inch.

56. The ballistic resistant protective garment of claim 43 in which the first and second panels each have a plurality of at least two of said overlying layered sheets, a plurality of stitches disposed into the first panel connecting the plurality of sheets together within the first panel in which the plurality of stitches includes at least one row of stitches aligned in a first direction, and another plurality of stitches disposed into the second panel connecting the plurality of sheets together within the second panel in which the other plurality of stitches includes at least two rows of stitches aligned in second and third directions transverse to one another and in which the row of stitches in the first panel aligned in the first direction is transverse to the rows in the second and third directions in the second panel.

57. The ballistic resistant protective garment of claim 56 in which the plurality of stitches are disposed in the first panel only and in which the other plurality of stitches are disposed in the second panel only.

58. The ballistic resistant protective garment of claim 56 in which the stitches of the first panel and the other stitches of the second panel are both composed of an aramid fiber.

59. The ballistic resistant protective garment of claim 56 in which the plurality of stitches disposed in the first panel includes a plurality of rows of stitches substantially parallel to one another and spaced apart from one another and are substantially aligned in the first direction and in which the plurality of stitches has another plurality of rows of stitches substantially parallel to one another and spaced apart from one another in which the other plurality of rows of stitches are positioned transverse to the plurality of rows of stitches in the first direction, and the other plurality of stitches disposed in the second panel includes a plurality of rows of stitches substantially parallel to one another and spaced apart from one another and aligned substantially in the second direction and in which the other plurality of stitches includes another plurality of rows of stitches substantially parallel to one another and spaced apart and aligned substantially in the third direction.

60. The ballistic resistant protective garment of claim 59 in which the rows of stitches and the other rows of stitches in the first panel are substantially perpendicular, and in which the plurality of rows and the other plurality of rows of stitches of the second panel are substantially perpendicular.

61. The ballistic resistant protective garment of claim 60 in which the plurality of rows and the other plurality of rows of stitches of the first panel each extend substantially across the first panel, and the plurality of rows and the other plurality of rows of stitches of the second panel each extend substantially across the second panel.

62. The ballistic resistant protective garment of claim 59 in which the plurality of rows of stitches and the other plurality of rows of stitches of the first panel form a pattern of quilt stitches in the first panel, and in which the plurality of rows and the other plurality of rows of stitches of the second panel form a pattern of box stitches in the second panel.

63. The ballistic resistant protective garment of claim 43 in which the first panel is positioned on the strike side of the pad, the third panel is positioned on the body side of the pad and the second panel is positioned intermediate of the first and second panel.

64. A ballistic resistant protective garment comprising:

a ballistic resistant pad having at least three panels;

a first panel constructed of a plurality of overlying layered sheets formed from a weave of a first type of high tensile strength fibers;

a second panel constructed of a plurality of overlying layered sheets formed from a weave of fibers constructed of lyotropic liquid crystal polymer material;

a third panel constructed of a plurality of overlying layers of composite body armor material in which the first, second and third panels of the pad are in overlying relationship to one another; and at least one row of multi-panel securement stitches disposed through the first and second panels which extend in a substantially vertical direction between a top edge and a bottom edge of the first and second panels.

65. The ballistic resistant protective garment of claim 64 in which said at least one row of multi-panel securement stitches extend from the top to the bottom edges of the first and second panels.

66. The ballistic resistant protective garment of claim 64 in which said at least one row of multi-panel securement stitches are disposed through the first and second panels only.

67. The ballistic resistant protective garment of claim 64 in which said at least one row of multi-panel securement stitches are positioned centrally between a right edge and a left edge of the first and second panels.

68. The ballistic resistant protective garment of claim 64 in which the at least one row of multi-panel securement stitches includes at least two rows of stitches spaced apart and substantially parallel to one another.

69. A ballistic resistant protective garment comprising:

a ballistic resistant pad having at least three panels;

a first panel constructed of a plurality of overlying layered sheets formed from a weave of a first type of high tensile strength fibers;

a second panel constructed of a plurality of overlying layered sheets formed from a weave of fibers constructed of lyotropic liquid crystal polymer material; and a third panel constructed of a plurality of overlying layers of composite body armor material in which the first, second and third panels of the pad are in overlying relationship to one another and in which each of the plurality of overlying layers of composite body armor material in the third panel is constructed of a plurality of sub-layer resin plies in which each ply has a high tensile strength fiber extending and disposed therein, in which the high tensile strength fiber of one ply extends transverse to the high tensile strength fiber of an adjacent ply and a laminate covering to enclose and sandwich together the sub-layer plies of resin and high tensile strength fiber forming a single layer of the plurality of layers of the third panel.

70. The ballistic resistant protective garment of claim 69 in which the high tensile strength fibers extending and disposed in the sub-layer resin plies is an aramid.

71. The ballistic resistant protective garment of claim 70 in which the high tensile strength fibers are generally 1500 denier.

72. The ballistic resistant protective garment of claim 70 in which the sub-layer resin plies are constructed of an aqueous thermoplastic.

73. The ballistic resistant protective garment of claim 70 in which the laminate covering includes thermoplastic polyethylene film.

74. The ballistic resistant protective garment of claim 69 includes four sub-layer plies.

75. The ballistic resistant protective garment of claim 69 in which the high tensile strength fibers disposed within a first sub-layer ply of resin is positioned in a first direction and the high tensile strength fibers disposed in a second sub-layer ply of resin adjacent the first sub-layer ply are positioned in a direction substantially normal to the high tensile strength fibers in the first sub-layer ply.

76. The ballistic resistant protective garment of claim 75 including four sub-layer plies in which the high tensile strength fibers are positioned in a relative orientation of 0, 90, 0, 90 degrees in each successive sub-layer ply.

77. A ballistic resistant protective garment comprising:

a ballistic resistant pad having at least three panels;

a first panel constructed of plurality of overlying layered sheets formed from a weave of a first type of high tensile strength fibers;

a second panel constructed of a plurality of overlying layered sheets formed from a weave of fibers constructed of lyotropic liquid crystal polymer material;

a third panel constructed of a plurality of overlying layers of composite body armor material in which the first, second and third panels of the pad are in overlying relationship to one another; and at least one row of bar tac stitching positioned in a peripheral area of the ballistic resistant pad securing the first, second and third panels together.

78. The ballistic resistant protective garment of claim 77 in which the at least one row of bar tac stitching includes at least four rows of bar tac stitching.

79. The ballistic resistant protective garment of claim 78 in which each of the rows of bar tac stitching is no longer than one inch in length.

80. The ballistic resistant protective garment of claim 77 in which the first, second and third panels are secured together substantially in alignment to one another.

81. A ballistic resistant protective garment comprising:

a ballistic resistant pad having at least three panels;

a first panel constructed of a plurality of overlying layered sheets formed from a weave of fibers constructed of lyotropic liquid crystal polymer material; and a third panel constructed of a plurality of overlying layers of composite body armor material in which the first, second and third panels of the pad are in overlying relationship to one another, in which there are no more than ten sheets in the first panel, no more than seven sheets in the second panel and no more than two layers in the third panel and in which the pad formed by the first, second and third panels has an areal density not greater than 0.63 lbs/ft$^2$ and a thickness not greater than 0.16 inches having a ballistic resistance that prevents projectile penetration of the ballistic resistant pad according to NIJ Standard 0101.03 for Treat Level IIA.

82. A ballistic resistant protective garment comprising:

a ballistic resistant pad having at least three panels;

a first panel constructed of a plurality of overlying layered sheets formed from a weave of a first type of high tensile strength fibers;

a second panel constructed of a plurality of overlying layered sheets formed from a weave of fibers constructed of lyotropic liquid crystal polymer material; and a third panel constructed of a plurality of overlying layers of composite body armor material in which the first, second and third panels of the pad are in overlying relationship to one another in which there are no more than twelve sheets in the first panel, no more than seven sheets in the second panel and no more than three layers in the third panel and in which the pad formed by the first, second and third panels has an areal density not greater than 0.74 lbs/ft$^2$ and a thickness not greater than 0.19 inches having a ballistic resistance that prevents projectile penetration of the ballistic resistant pad according to NIJ Standard 0101.03 for Threat Level II.

83. A ballistic resistant protective garment comprising:

a ballistic resistant pad having at least three panels;

a first panel constructed of a plurality of overlying layered sheets formed from a weave of a first type of high tensile strength fibers;

a second panel constructed of a plurality of overlying layered sheets formed from a weave of fibers constructed of lyotropic liquid crystal polymer material; and a third panel constructed of a plurality of overlying layers of composite body armor material in which the first, second and third panels of the pad are in overlying relationship to one another, in which there are no more than fifteen sheets in the first panel, no more than seven sheets in the second panel and no more than five layers in the third panel and in which the pad formed by the first, second and third panels has an areal density not greater than 0.94 lbs/ft$^2$ and a thickness not greater than 0.24 inches having a ballistic resistance that prevents projectile penetration of the ballistic resistant pad according to NIJ Standard 0101.03 for Threat Level IIIA.

84. A ballistic resistant protective garment, comprising:

a first panel constructed of a plurality of overlying layered sheets constructed of woven aramid fibers;

a second panel constructed of a plurality of overlying layered sheets constructed of woven lyotropic liquid crystal polymer fibers; and a third panel constructed of a plurality of overlying layers of composite body armor material in which the first, second and third panels overlie one another to form a pad in which the pad has an areal density not greater than 0.63 lbs/ft$^2$ and has a ballistic resistance that prevents projectile penetration of the ballistic resistant pad according to NIJ Standard 0101.03 for Threat Level IIA.

85. A ballistic resistant protective garment, comprising:

a first panel constructed of a plurality of overlying layered sheets constructed of woven aramid fibers;

a second panel constructed of a plurality of overlying layered sheets constructed of woven lyotropic liquid crystal polymer fibers; and a third panel constructed of a plurality of overlying layers of composite body armor material in which the first, second and third panels overlie one another to form a pad in which the pad has a thickness not greater than 0.16 inches and has a ballistic resistance that prevents projectile penetration of the ballistic resistant pad according to NIJ Standard 0101.03 for Threat Level IIA.

86. A ballistic resistant protective garment, comprising:

a first panel constructed of a plurality of overlying layered sheets constructed of woven aramid fibers;

a second panel constructed of a plurality of overlying layered sheets constructed of woven lyotropic liquid crystal polymer fibers; and a third panel constructed of a plurality of overlying layers of composite body armor material in which the first, second and third panels overlie one another to form a pad in which the pad has an areal density not greater than 0.74 lbs/ft$^2$ and has a ballistic resistance that prevents projectile penetration of the ballistic resistant pad according to NIJ Standard 0101.03 for Threat Level II.

87. A ballistic resistant protective garment, comprising:

a first panel constructed of a plurality of overlying layered sheets constructed of woven aramid fibers;

a second panel constructed of a plurality of overlying layered sheets constructed of woven lyotropic liquid crystal polymer fibers; and a third panel constructed of a plurality of overlying layers of composite body armor material in which the first, second and third panels overlie one another to form a pad in which the pad has a thickness not greater than 0.19 inches and has a ballistic resistance that prevents projectile penetration of the ballistic resistant pad according to NIJ Standard 0101.03 for Threat Level II.

88. A ballistic resistant protective garment, comprising:

a first panel constructed of a plurality of overlying layered sheets constructed of woven aramid fibers;

a second panel constructed of a plurality of overlying layered sheets constructed of woven lyotropic liquid crystal polymer fibers; and a third panel constructed of a plurality of overlying layers of composite body armor material in which the first, second and third panels overlie one another to form a pad in which the pad has an areal density not greater than 0.94 lbs /ft$^2$ and has a ballistic resistance that prevents projectile penetration of the ballistic resistant pad according to NIJ Standard 0101.03 for Threat Level IIIA.

89. A ballistic resistant protective garment, comprising:

a first panel constructed of a plurality of overlying layered sheets constructed of woven aramid fibers;

a second panel constructed of a plurality of overlying layered sheets constructed of woven lyotropic liquid crystal polymer fibers; and a third panel constructed of a plurality of overlying layers of composite body armor material in which the first, second and third panels overlie one another to form a pad in which the pad has a thickness not greater than 0.24 inches and has a ballistic resistance that prevents projectile penetration of the ballistic resistant pad according to NIJ Standard 0101.03 for Threat Level III.

* * * * *

UNITED STATES PATENT AND TRADEMARK OFFICE

CERTIFICATE OF CORRECTION

PATENT NO. : 6,151,710
DATED : November 28, 2000
INVENTOR(S) : Thomas E. Bachner, Jr.

It is certified that error appears in the above-identified patent and that said Letters Patent is hereby corrected as shown below:

Column 6,
Line 1, change “maybe” to -- may be --.
Lines 17 and 18, change “place” to -- placed --.

Column 11,
Line 41, change “can” to -- can be --.

Column 24,
Line 38, change “III” to -- IIIA --.

Signed and Sealed this

Eleventh Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,151,710
DATED : November 28, 2000
INVENTOR(S) : Thomas E. Bachner, Jr.

It is certified that error appears in the above-identified patent and that said Letters Patent is hereby corrected as shown below:

Column 6,
Line 1, change “maybe” to -- may be --.
Lines 17 and 18, change “place” to -- placed --.

Column 11,
Line 41, change “can” to -- can be --.

Column 22,
Line 4, after “of” insert the following:

-- a first type of high tensile strength fibers;
-- a second panel constructed of a plurality of overlying layered sheets formed from a weave of --.

Column 24,
Line 38, change “III” to -- IIIA --.

Signed and Sealed this

Tenth Day of June, 2003

JAMES E. ROGAN
*Director of the United States Patent and Trademark Office*